US007938257B2

(12) United States Patent
Kohler

(10) Patent No.: US 7,938,257 B2
(45) Date of Patent: May 10, 2011

(54) BLANKS AND METHODS FOR FORMING A BEVERAGE CARRIER FROM THE BLANKS

(75) Inventor: Karl A. Kohler, Bartlett, IL (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 12/479,130

(22) Filed: Jun. 5, 2009

(65) Prior Publication Data

US 2009/0236252 A1 Sep. 24, 2009

Related U.S. Application Data

(63) Continuation of application No. 11/697,392, filed on Apr. 6, 2007, now Pat. No. 7,552,820.

(60) Provisional application No. 60/744,558, filed on Apr. 10, 2006.

(51) Int. Cl.
*B65D 5/46* (2006.01)

(52) U.S. Cl. ..... 206/163; 206/166; 229/117.22

(58) Field of Classification Search ..... 206/163, 206/164, 165, 166, 427; 229/103, 103.2, 229/117.09, 117.22

See application file for complete search history.

(56) References Cited

U.S. PATENT DOCUMENTS 2,609,137 A * 9/1952 Toensmeier ..... 206/166
2,675,158 A * 4/1954 Ringler ..... 206/173
2,684,178 A 7/1954 Keeler
2,704,617 A 3/1955 Stieve
3,065,876 A * 11/1962 Gioia ..... 206/166
3,202,312 A * 8/1965 Atkinson ..... 206/166
3,258,152 A * 6/1966 Cameron ..... 206/166
3,294,279 A * 12/1966 Kidd ..... 206/166
3,511,434 A * 5/1970 Dews ..... 229/117.09
3,531,042 A * 9/1970 Atkinson ..... 229/243
3,554,402 A 1/1971 Lock
3,578,238 A 5/1971 Schillinger et al.
3,677,458 A 7/1972 Gosling
3,688,972 A 9/1972 Mahon
3,820,710 A * 6/1974 Burgess et al. ..... 229/117.22
3,825,171 A * 7/1974 Dewhurst ..... 206/166
3,904,036 A 9/1975 Forrer
4,039,120 A 8/1977 Herzog
4,201,322 A 5/1980 Crawford
4,295,598 A 10/1981 Calvert
4,327,829 A 5/1982 Hughes
4,403,690 A * 9/1983 Fischer ..... 206/163
4,533,052 A 8/1985 Fruchey et al.
5,029,698 A 7/1991 Stout
5,065,937 A 11/1991 Ritter (Continued)

*Primary Examiner* — Jacob K Ackun, Jr.
(74) *Attorney, Agent, or Firm* — Womble Carlyle Sandridge & Rice, PLLC

(57) ABSTRACT

A beverage carrier including at least two cartons and a tray having a retractable handle for holding the cartons is provided. The cartons and the tray are each formed from blanks of sheet material. Each carton includes a first and second side wall, a top panel, a bottom panel, and first and second end walls, wherein the side walls, the top panel, the bottom panel and the end walls are interconnected to form the carton. The tray includes a first and second side panel, a first and second bottom panel, a first and second divider panel, and a first and second end panel. The tray includes an opening through which a retractable handle is placed. The retractable handle is configured to move between a recessed position and an extended position. The tray is configured to hold at least two cartons for easy transport and storage.

12 Claims, 9 Drawing Sheets

U.S. PATENT DOCUMENTS

| | | | | |
|---|---|---|---|---|
| 5,156,269 | A | 10/1992 | Bakx | |
| 5,197,598 | A | 3/1993 | Stout et al. | |
| 5,246,112 | A | 9/1993 | Stout et al. | |
| 5,400,955 | A | 3/1995 | Coalier et al. | |
| 5,647,483 | A | 7/1997 | Harris | |
| 5,699,957 | A | 12/1997 | Blin et al. | |
| 5,704,470 | A | 1/1998 | Sutherland | |
| 6,105,853 | A | 8/2000 | Lamare | |
| 6,227,367 | B1 | 5/2001 | Harrelson et al. | |
| 6,334,531 | B1 * | 1/2002 | Valkovich | 206/163 |
| 6,536,656 | B2 | 3/2003 | Auclair et al. | |
| 6,631,803 | B2 | 10/2003 | Rhodes et al. | |
| 6,695,137 | B2 | 2/2004 | Jones et al. | |
| 6,869,009 | B2 | 3/2005 | Sutherland et al. | |
| 6,968,992 | B2 | 11/2005 | Schuster | |
| 2005/0103651 | A1 | 5/2005 | Lebras | |
| 2005/0211577 | A1 | 9/2005 | Bakx | |
| 2005/0230273 | A1 | 10/2005 | Kohler | |

* cited by examiner

BLANKS AND METHODS FOR FORMING A BEVERAGE CARRIER FROM THE BLANKS

CROSS REFERENCE TO RELATED APPLICATIONS

This application is a continuation of U.S. patent application Ser. No. 11/697,392, filed Apr. 6, 2007 now U.S. Pat. No. 7,552,820, which claims the benefit of U.S. Provisional Application No. 60/744,558, filed Apr. 10, 2006, both of which are incorporated by reference herein in their entirety.

BACKGROUND OF THE INVENTION

This invention relates generally to beverage carriers formed from sheet material, and more particularly to trays for carrying cartons holding multiple beverage containing units, blanks of sheet material for producing the trays and cartons, and methods and apparatus for forming the trays and cartons.

The desire for convenience has led to many beverages being packaged in various manners by manufacturers for later consumption by purchasers. Different beverages are often sealed within various sized individual units, often bottles or cans. It is desirable to package multiple units together to facilitate easy purchase, transport, and storage of the units. It is also desirable to provide a package that facilitates transportation of the package while also providing an area for printing and graphics on the package. Such printing and graphics can include advertising for the beverages included therein, and thus, may result in increased sales of the beverages.

The larger the number of units packaged together, the heavier and more cumbersome the carton holding the units becomes. The cartons may be difficult and uncomfortable to carry. Attempts to provide comfortable carrying means often interfere with stacking of the cartons for convenient storage in warehouses or stores. Current cartons can also be difficult to fit onto shelves, into cupboards, or as is often desired, into a refrigerator once the carton is purchased and brought to a destination.

BRIEF DESCRIPTION OF THE INVENTION

In one aspect, a carrier for transporting a plurality of beverage containers is provided. The carrier includes at least two cartons, with each said carton formed from a blank of sheet material. The carrier also includes a tray formed from a blank of sheet material, that includes a first end wall, a second end wall, a first side wall, a second side wall, a bottom wall, and a divider wall extending between the first end wall and the second end wall, with the divider wall dividing the tray into a first carton holding area and a second carton holding area, The carrier further includes a retractable handle formed from a blank of sheet material, and including an opening located in an upper portion. The handle is located inside the tray divider wall and extends through a handle opening in the divider wall, with the handle movable from a retracted position to an extended position. The at least two cartons are removably positioned in the tray.

In another aspect, a carrier assembly for transporting a plurality of beverage containers that is formed from a tray blank of sheet material, a carton blank of sheet material, and a handle blank of sheet material is provided. The tray blank includes a first and a second bottom panel having an inner edge and an outer edge, a first side panel extending from the outer edge of the first bottom panel and a second side panel extending from the outer edge of the second bottom panel, a first divider panel extending from the inner edge of the first bottom panel and a second divider panel extending from the inner edge of the second bottom panel with the first and second divider panels coupled along a divider fold line. The tray blank also includes a handle opening extending along a portion of the fold line coupling the first and the second divider panels; and a first and a second end panel extending from opposing ends of the second bottom panel. The handle blank includes a first handle panel and a second handle panel coupled by a handle fold line and symmetrical about the handle fold line. The first and second handle panels each include an upper portion and a bottom portion. A width of the handle upper portion is less than a width of the handle lower portion so that the handle upper portion is extendable through the handle opening in the tray divider wall and the handle lower portion engages the divider fold line to prevent the second handle portion from extending through the handle opening.

In another aspect, a method of constructing a carrier for transporting a plurality of beverage containers is provided. The method includes providing a continuous tray blank of sheet material, the tray blank including a first and a second bottom panel, each bottom panel including an inner edge and an outer edge, a first side panel extending from the outer edge of the first bottom panel and a second side panel extending from the outer edge of the second bottom panel, a first divider panel extending from the inner edge of the first bottom panel and a second divider panel extending from the inner edge of the second bottom panel, first and second divider panels coupled along a divider fold line, a handle opening extending along a portion of the fold line coupling the first and second divider panels, a first and a second end panel extending from opposing ends of the second bottom panel, a first and a second connecting flap extending from opposing ends of the first side panel, a third and a fourth connecting flap extending from opposing ends of the first divider panel, and a fifth and a sixth connecting flap extending from opposing ends of the second side panel. The second bottom panel includes a plurality of tabs extending from the second panel at an edge adjacent the second divider panel. The first divider panel and the second divider panel include a plurality of aligned tab openings sized to receive the second bottom panel tabs. The method also includes providing a continuous handle blank of sheet material, the handle blank including a first handle panel and a second handle panel coupled by a handle fold line and symmetrical about the handle fold line. The first and second handle panels each include an upper portion and a bottom portion. A width of the handle upper portion is less than a width of the handle lower portion so that the handle upper portion is extendable through the handle opening in the tray divider wall and the handle lower portion engages the divider fold line to prevent the second handle portion from extending through the handle opening. The method further includes forming the handle by folding the blank along the fold line, forming the tray by folding the first and second side panels about respective fold lines, folding first and second divider panels into a planar relationship with formed handle sandwiched between first and second divider panels and handle first portion extending through the handle opening, folding first and second bottom panels about respective fold lines, folding first and second upper and lower end panels about respective fold lines, folding first, second, third, fourth, fifth, and sixth connecting flaps about respective fold lines, coupling first, third, and fifth connecting flaps to first end panel, and coupling second, fourth, and sixth connecting flaps to second end panel, and inserting the plurality of tabs extending from the inner edge of second bottom panel into the plurality of aligned openings in the first and second divider panels. The divider panels dividing the tray into a first carton holding area and a second carton holding area.

DETAILED DESCRIPTION OF THE INVENTION

A carrier for transporting a plurality of beverage containers that includes at least one carton and a tray having a retractable handle, and a method for constructing the cartons and tray are described in detail below. The carriers are easily stacked for display or storage with the retractable handle in a retracted position. With the handle in an extended position, a customer can easily carry the carrier from the point of purchase. Also, the cartons are sized to permit storage in a refrigerator, including door trays and also provide easy access to the beverage containers through a tear strip.

The cartons and tray are constructed using a machine from separate blanks of sheet material. In one embodiment, the cartons and tray are fabricated from a paperboard material. In other embodiments, the cartons and tray are fabricated using any suitable material, and therefore, are not limited to a specific type of material. In alternative embodiments, the cartons and tray are fabricated using cardboard, plastic and/or any suitable material known to those skilled in the art and guided by the teachings herein provided.

In an exemplary embodiment, the cartons and tray include markings thereon that include, without limitation, indicia that communicates the product, a manufacturer of the product and/or seller of the product. For example, the markings can include printed text that indicate a product's name and briefly describe the product, logos and/or trademarks that indicate a manufacturer and/or seller of the product, and/or designs and/or ornamentation that attract attention. Since the beverage carrier includes multiple cartons and a tray including a handle, the separate parts can each be printed with different indicia, which allows for flexibility in marketing and promotion.

Figure 1:
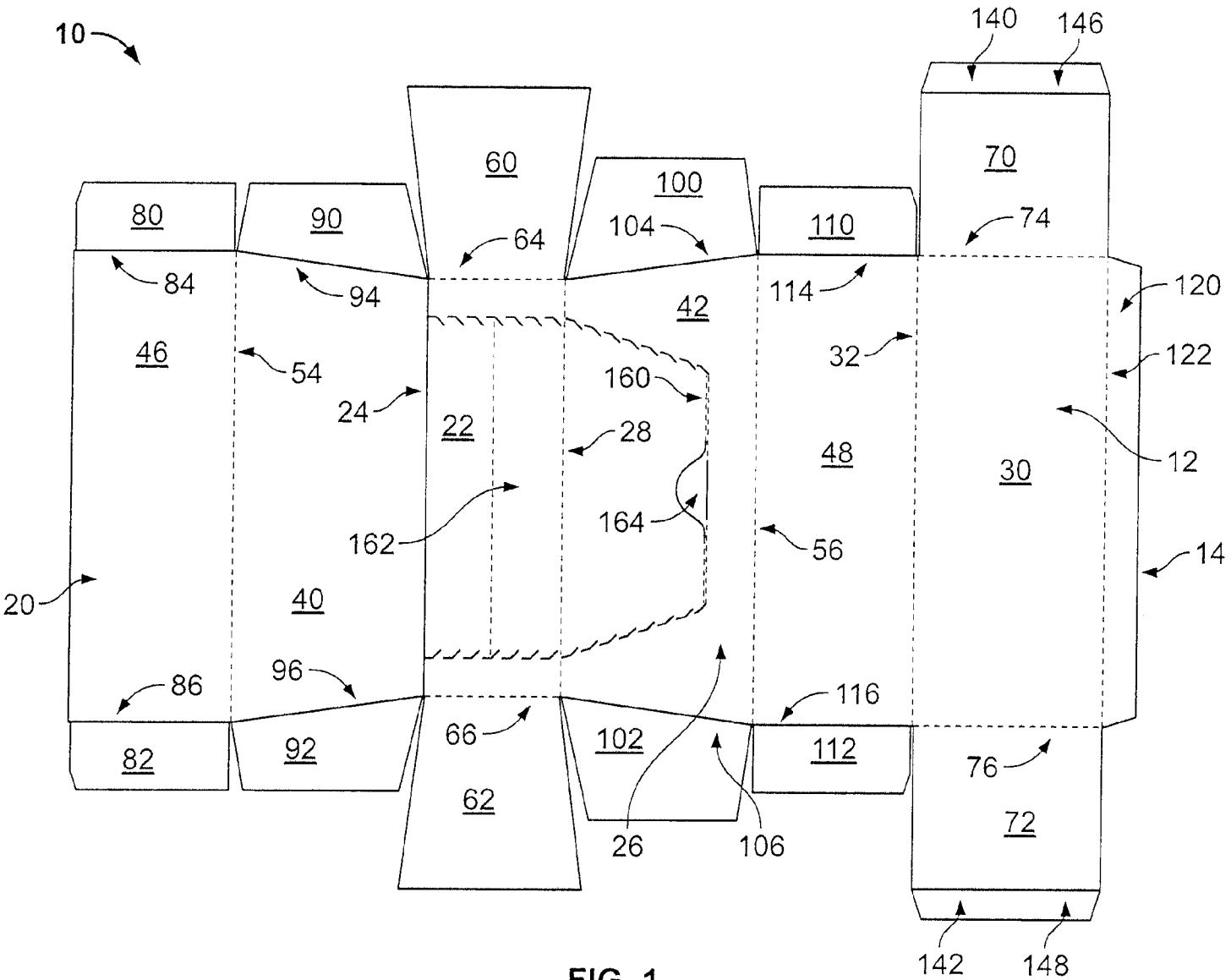
FIG. 1 is a top plan view of a blank of sheet material for constructing a carton according to one embodiment of this invention.

Referring to the drawings, a beverage carrier can have any suitable size, shape and/or configuration. FIG. 1 illustrates the construction or formation of a carton for holding a plurality of beverage containers. Specifically, FIG. 1 is a top plan view of one embodiment of a blank 10 of sheet material.

Blank 10 has an exterior surface 12 and an opposing interior surface 14. In the exemplary embodiment, blank 10 includes a first side wall 20 connected to a top panel 22 across a fold line 24. A second side wall 26 is connected to top panel 22 along an edge opposing first side wall 20 across a fold line 28. A bottom panel 30 is attached to second side wall 26 across a fold line 32. Each side wall 20 and 26 includes an upper side panel 40 and 42 respectively, and a lower side panel 46 and 48 respectively. Upper side panels 40 and 42 are the portion of each side wall 20 and 26 connected to top panel 22. Upper side panels 40 and 42 are separated from lower side panels 46 and 48 by fold lines 54 and 56 respectively.

Top panel 22 is also connected to two opposing upper end flaps 60 and 62. Upper end flap 60 is connected to top panel 22 at fold line 64, and upper end flap 62 is connected to top panel 22 at fold line 66. Bottom panel 30 is connected to two opposing lower end flaps 70 and 72. Lower end flap 70 is connected to bottom panel 30 at fold line 74, and lower end flap 72 is connected to bottom panel 30 at fold line 76. It is apparent to those skilled in the art and guided by the teachings herein provided that fold lines 24, 28, 32, 54, 56, 62, 64, 74 and 76 as well as other fold lines described herein, may include any suitable line of weakening known to those skilled in the art and guided by the teachings herein provided.

Further, lower side panel 46 is connected to two opposing side flaps 80 and 82, wherein side flaps 80 and 82 are separated from lower side panel 46 by fold lines 84 and 86 respectively. Upper side panel 40 is connected to two opposing side flaps 90 and 92, wherein side flaps 90 and 92 are separated from upper side panel 40 by fold lines 94 and 96 respectively. Upper side panel 42 is connected to two opposing side flaps 100 and 102, wherein side flaps 100 and 102 are separated from upper side panel 42 by fold lines 104 and 106 respectively. Lower side panel 48 is connected to two opposing side flaps 110 and 112, wherein side flaps 110 and 112 are separated from lower side panel 48 by fold lines 114 and 116 respectively. A glue flap 120 extends from bottom panel 30, from the edge opposed to second side wall 26, and is separated from bottom panel 30 by a fold line 122. Glue flaps 140 and 142 extend from lower end flaps 70 and 72 respectively, on the edges opposed to bottom panel 30, and are separated from lower end flaps 70 and 72 by fold lines 146 and 148.

Top panel 22 and upper side panel 42 of second side wall 26 include a perforated line 160 for forming an opening 162 that allows for access to the cartons contents. A starting tab 164 is included along perforated line 160 to aid in tearing open access area 162. In operation, starting tab 164 would be used to facilitate separation of the access panel along perforated line 160 to create opening 162 for allowing access to the contents stored within the carton.

Figure 2:
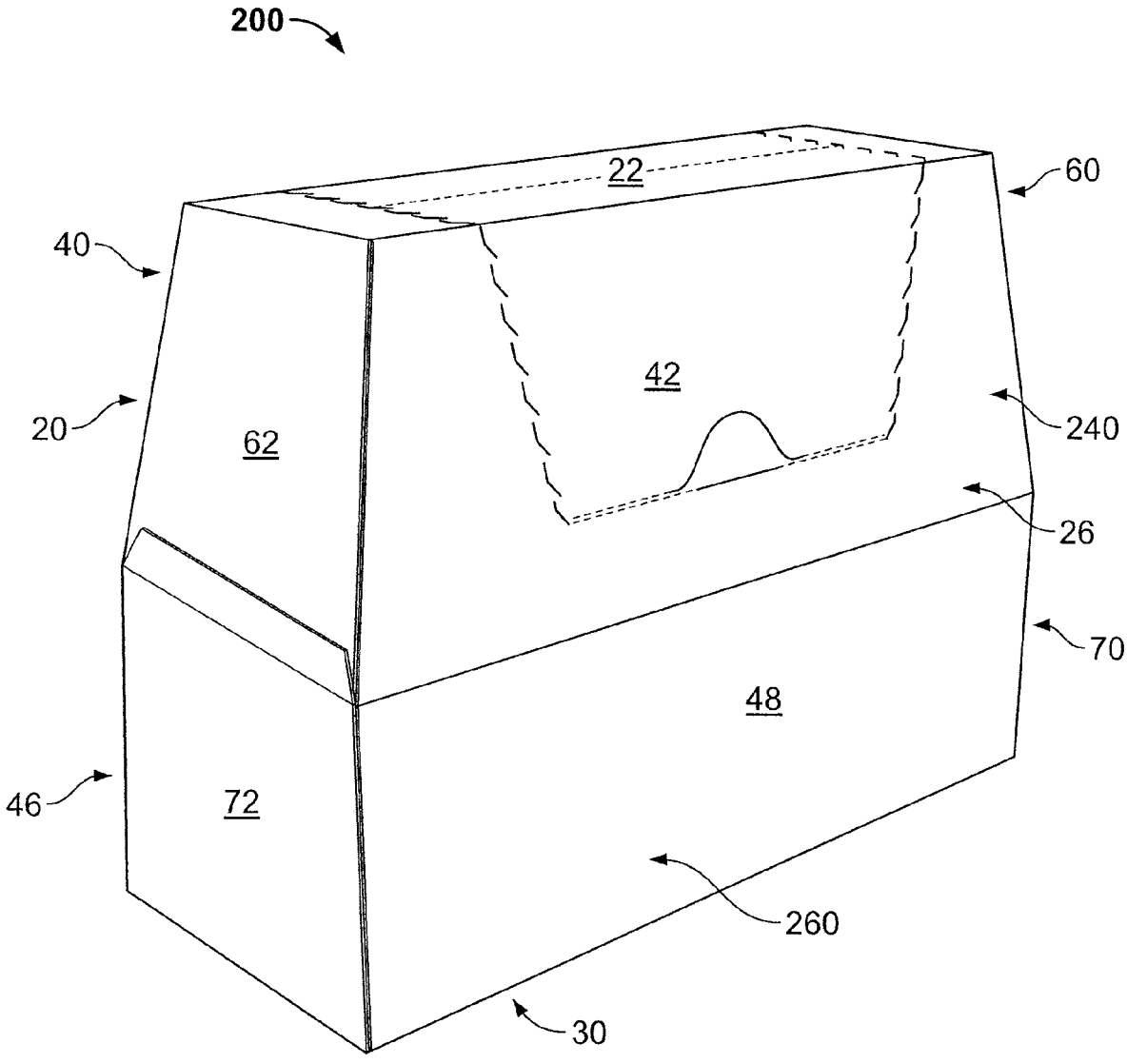
FIG. 2 is a perspective view of a carton constructed from the blank shown in FIG. 1.

FIG. 2 is a perspective view of a carton 200 constructed from blank 10 shown in FIG. 1 and described in detail above. Carton 200 is formed from blank 10 by folding first side wall 20 about fold line 24, second side wall 26 about fold line 28, and bottom panel 30 about fold line 32. Glue flap 120 is folded about fold line 122 and into a planar relationship with an edge of first side wall 20 to form a tubular structure. To enclose carton 200, the side flaps are folded about their respective fold lines. For example, upper end flaps 60 and 62 are folded about fold lines 64 and 66, and lower end flaps 70 and 72 are folded about fold lines 74 and 76. Glue flaps 140 and 142 are folded about fold lines 146 and 148, where glue flaps 140 and 142 overlap upper end flaps 60 and 62 in a planar relationship.

As can be seen in FIG. 1 and FIG. 2, top panel 22 and bottom panel 30 are both rectangular. However, both the height and width of top panel 22 are less than the height and width of bottom panel 30. When formed, carton 200 includes a trapezoidal upper portion 240 and a rectangular bottom portion 260. Trapezoidal upper portion 240 includes top panel 22, upper side panels 40 and 42, and upper end flaps 60 and 62. Rectangular bottom portion 260 includes bottom panel 30, lower side panels 46 and 48, and lower end flaps 70 and 72. Upper side panels 40 and 42 and upper end flaps 60 and 62 angle inwardly toward top panel 22. The trapezoidal shape of upper portion 240 allows carton 200 to better conform to the shape of the bottles contained within the carton than is possible with a purely rectangular carton. The unique shape also attracts attention in a retail environment. The dimensions of rectangular bottom portion 260 may be chosen such that carton 200 fits within a refrigerator door shelf.

FIG. 2 shows that in a formed state, top panel 22 of carton 200 is parallel and opposed to bottom panel 30, first side wall 20 is opposed to second side wall 26, and end flaps 60 and 70 are opposed to end flaps 62 and 72. When assembled, lower side panels 46 and 48 are substantially perpendicular to bottom panel 30. Since top panel 22 is narrower than bottom panel 30, upper side panels 40 and 42 are angled inwardly, from lower side panels 46 and 48 toward top panel 22.

In a similar manner to side walls 20 and 26, end flaps 60, 62, 70, and 72 form an upper portion and a lower portion of the carton. In contrast to side walls 20 and 26 where the two portions are separated by a fold line, the two portions of the end walls are created by separate flaps. Lower end flaps 70 and 72 are substantially perpendicular to bottom panel 30 and lower side panels 46 and 48. Upper end flaps 60 and 62 angle inwardly from lower end flaps 70 and 72 toward top panel 22.

Figure 3:
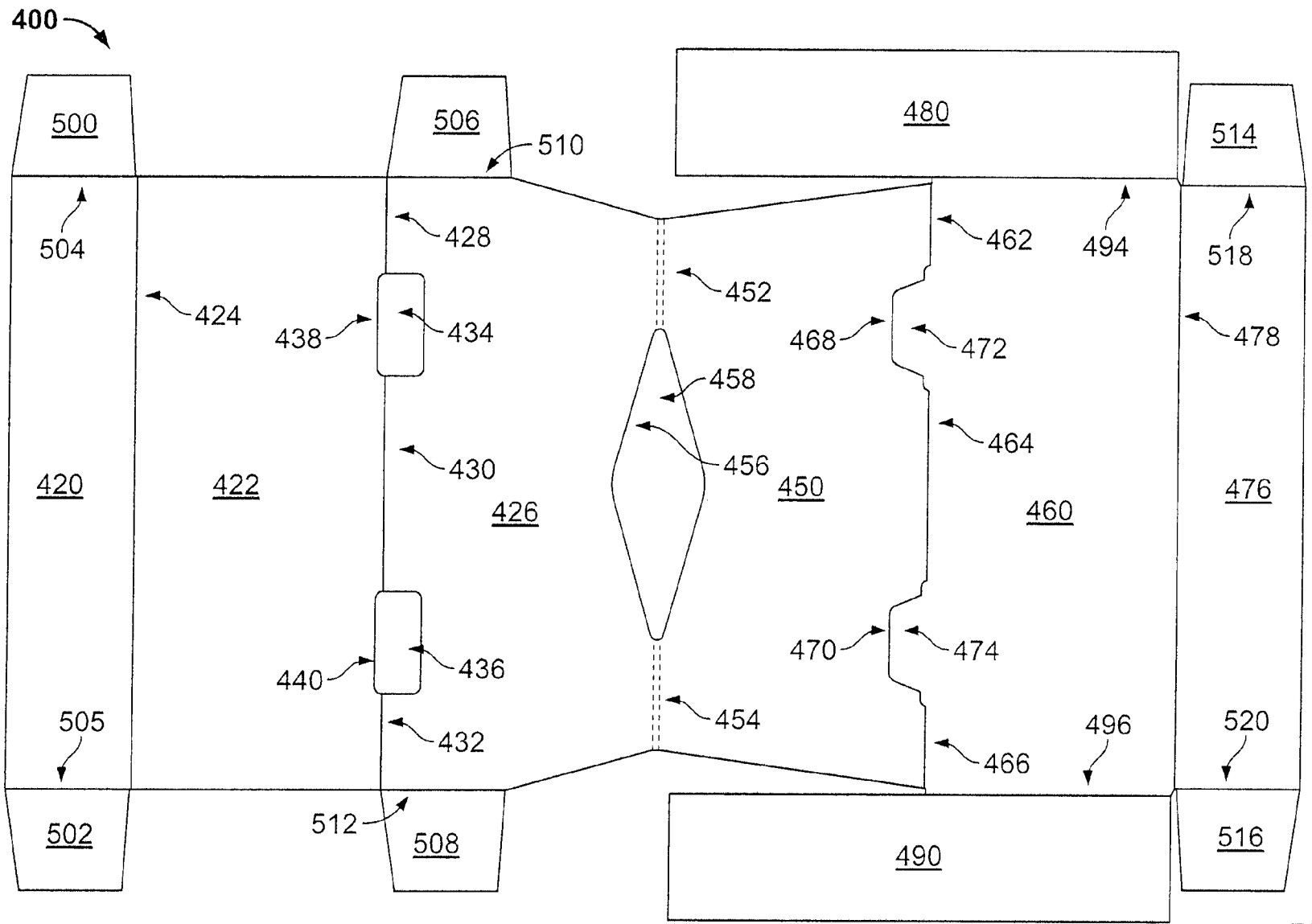
FIG. 3 is a top plan view of a blank of sheet material for constructing a tray according to one embodiment of this invention.

FIG. 3 is a top plan view of a blank 400 of sheet material for constructing a tray according to an exemplary embodiment. Blank 400 includes a first side panel 420 connected to a first bottom panel 422 across a fold line 424. First bottom panel 422 is connected to a first divider panel 426, on an edge opposing first side panel 420. First bottom panel 422 and first divider panel 426 are separated by fold lines 428, 430, and 432, and also by openings 434 and 436 which are created within first divider panel 426 by cut lines 438 and 440 respectively. First divider panel 426 is connected to a second divider panel 450, on an edge opposing first bottom panel 422. First divider panel 426 and second divider panel 450 are separated by fold lines 452 and 454, and also, by a cut line 456 that defines an opening 458. Second divider panel 450 is connected to a second bottom panel 460, on an edge opposing first divider panel 426. Second divider panel 450 and second bottom panel 460 are separated by fold lines 462, 464, and 466, and also by cut lines 468 and 470 that define tabs 472 and 474 respectively. Tabs 472 and 474 extend from second bottom panel 460. Second bottom panel 460 is connected to a second side panel 476, on an edge opposing second divider panel 450, by a fold line 478.

Second bottom panel 460 is connected to two opposing end panels 480 and 490, and is separated from second bottom panel 460 by fold lines 494 and 496 respectively. First side panel 420 is connected to two opposing flaps 500 and 502, and is separated from flaps 500 and 502 by fold lines 504 and 505 respectively. First divider panel 426 is connected to two opposing flaps 506 and 508, and is separated from flaps 506 and 508 by fold lines 510 and 512. Second side panel 476 is connected to two opposing flaps 514 and 516, and is separated from flaps 514 and 516 by fold lines 518 and 520.

Figure 4:
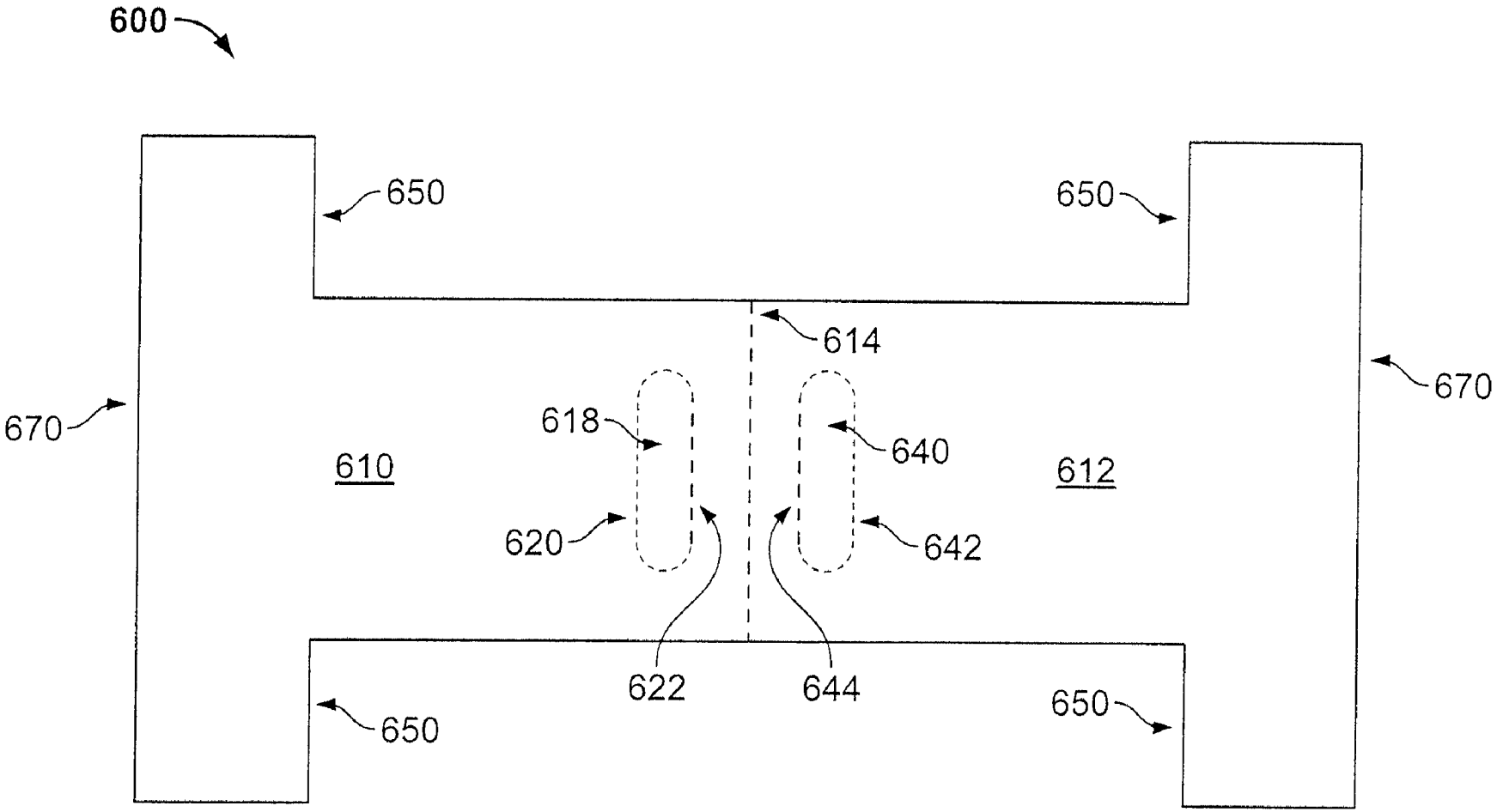
FIG. 4 is a top plan view of a blank of sheet material for constructing a handle according to one embodiment of this invention.

FIG. 4 is a top plan view of a blank 600 of sheet material for constructing a handle according to one embodiment of this invention. Blank 600 includes a first handle panel 610 and a second handle panel 612 that are separated by a fold line 614. First and second handle panels 610 and 612 are symmetrical about fold line 614. First handle panel 610 contains an opening 618 that is defined by a cut line 620 and a fold line 622. Second handle panel 612 contains an opening 640 that is defined by a cut line 642 and a fold line 644. Each handle panel 610 and 612 includes a pair of shoulders 650 and a bottom edge 670.

Figure 5:
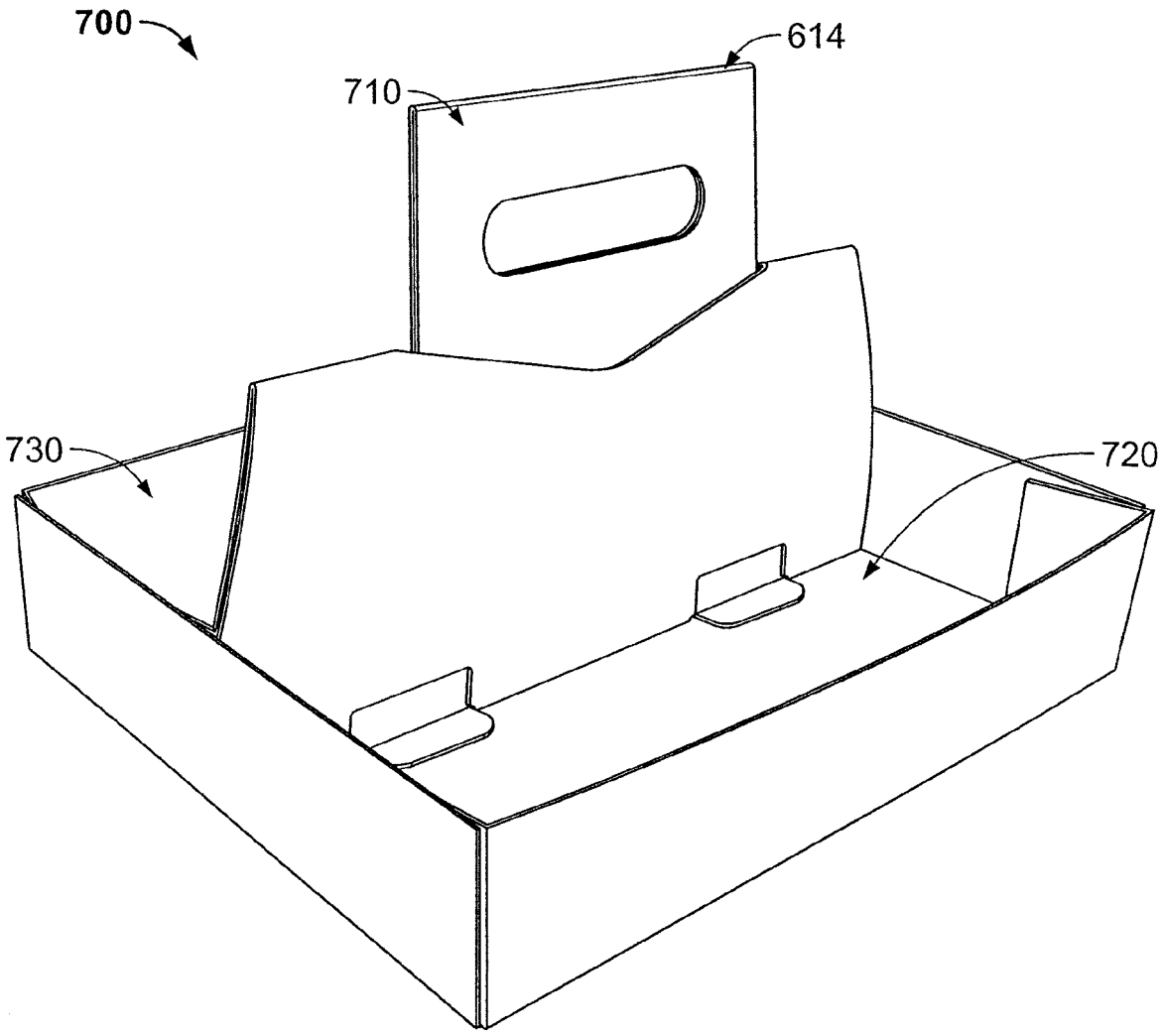
FIG. 5 is a perspective view of a tray constructed from the blank shown in FIG. 3 including a handle constructed from the blank shown in FIG. 4, wherein the handle is shown in a recessed state.
Figure 6:
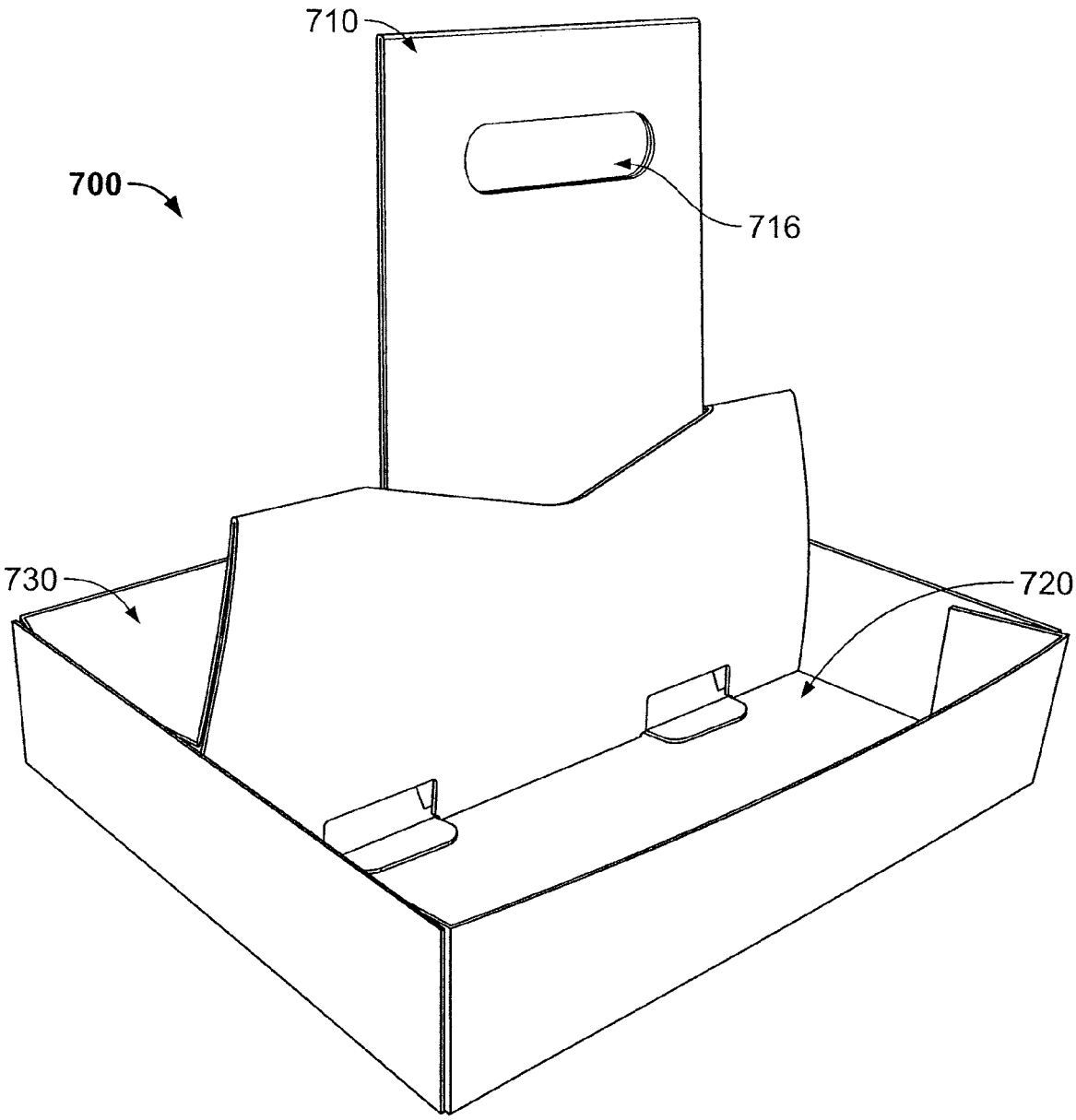
FIG. 6 is a perspective view of a tray constructed from the blank shown in FIG. 3 including a handle constructed from the blank shown in FIG. 4, wherein the handle is shown in an extended state.

FIG. 5 is a perspective view of a tray 700 constructed from blank 400 shown in FIG. 3 and described above, including a handle 710 constructed from blank 600 shown in FIG. 4 and described above, with handle 710 shown in a recessed state. FIG. 6 is a perspective view of tray 700 with handle 710 shown in an extended state.

Handle 710 is formed from blank 600 by folding first handle panel 610 along fold line 614 into a planar relationship with second handle panel 612. This aligns openings 618 and 640 forming a single opening 716 for the user to extend their fingers through, and aligns shoulders 650 and bottom edges 670. Formed handle 710, beginning with fold line 614, is inserted into opening 458 of blank 400. Tray 700 is formed from blank 400 and blank 600 by folding first side panel 420 and second side panel 476 about fold lines 424 and 478 respectively, and folding first divider panel 426 and second divider panel 450 into a planar relationship, with formed handle 710 sandwiched between divider panels 426 and 450. First bottom panel 422 is folded about fold lines 428, 430, and 432, and second bottom panel 460 is folded about fold lines 462, 464, and 466, which aligns tabs 472 and 474 for insertion within openings 434 and 436 respectively.

First end panel 480 is folded about fold line 494 and flaps 500, 506, and 514 are folded about their respective fold lines. Flaps 500, 506, and 514 lay flat against first end panel 480 in a planar relationship. Flaps 500, 506, and 514 are coupled to first end panel 480 using a suitable coupler, such as an adhesive material strip or tape applied to flaps 500, 506, or 514, or first end panel 480. Second end panel 490 is folded about fold line 496 and flaps 502, 508, and 516 are folded about their respective fold lines. Flaps 502, 508, and 516 lay flat against second end panel 490 in a planar relationship. Flaps 502, 508, and 516 are coupled to second end panel 490 using a suitable coupler, such as an adhesive material strip or tape applied to flaps 502, 508, or 516, or second end panel 490.

In the formed state, first side panel 420 and second side panel 476 of tray 700 extend substantially parallel to and at a distance from one another. Additionally, first divider panel 426 and second divider panel 450 are aligned in a planar relationship and extend substantially parallel to and from a location between first and second side panels 420 and 476. Moreover, end panels 480 and 490 extend substantially perpendicularly with respect to first and second side panels 420 and 476. Openings 434 and 436 align to accept tabs 472 and 474 respectively which extend from second bottom panel 460.

Once tray 700 is formed, handle 710 is free to slide between first divider panel 426 and second divider panel 450. When inserted into openings 434 and 436 respectively, tabs 472 and 474 contain handle 710 between first divider panel 426 and second divider panel 450. When in a retracted state, bottom edge 670 of handle 710 is in contact with tabs 472 and 474. When in an extended state, shoulders 650 contain handle 710 between first divider panel 426 and second divider panel 450 because shoulders 650 are wider than opening 458. When handle 710 is in an extended state, shoulders 650 abut fold lines 452 and 454 respectively, which in combination with tabs 472 and 474, prevent a user from removing handle 710 from tray 700.

Referring to FIGS. 5 and 6, once formed, tray 700 includes two areas 720 and 730 each designed to hold a carton, for example, carton 200.

Figure 7:
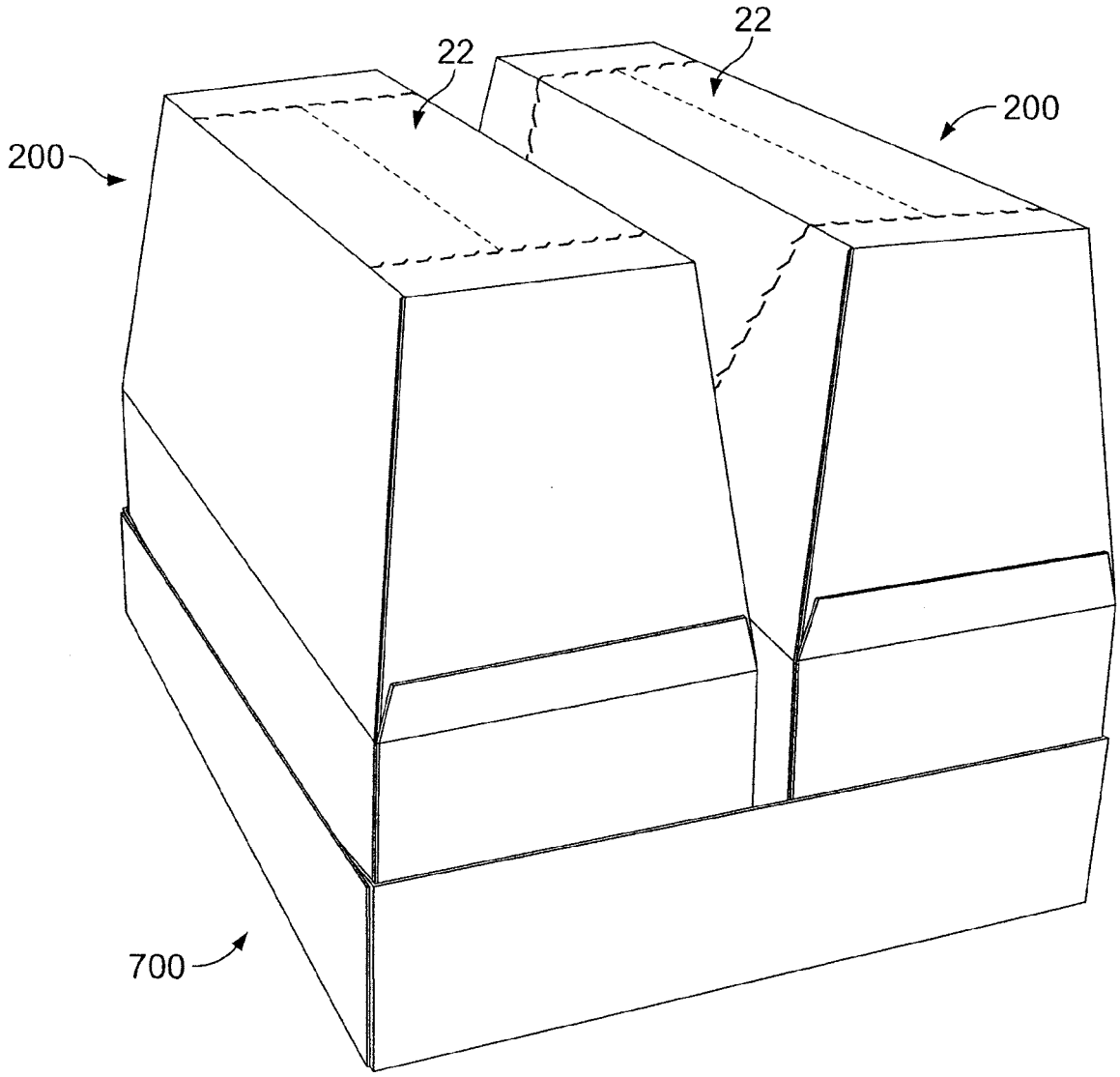
FIG. 7 is a perspective view of two cartons constructed from the blank shown in FIG. 1 placed within a tray constructed from the blank shown in FIG. 3 including a handle constructed from the blank shown in FIG. 4, wherein the handle is shown in a recessed state.

FIG. 7 is a perspective view of two cartons 200 constructed from blank 10 shown in FIG. 1, placed within tray 700 constructed from blank 400 shown in FIG. 3 and blank 600 shown in FIG. 4. When the cartons are placed within the tray, bottom panels 30 of the cartons are aligned with bottom panels 422 and 460 of tray 700. The cartons are held in place on one side by divider panels 426 and 450, on another side by first and second end panels 480 and 490, and on the other two sides by side panels 420 and 476.

Further referring to FIG. 7, when handle 710 is in a retracted state, bottom edge 670 of handle 710 is in contact with tabs 472 and 474. In this state, when the cartons are in place within the tray, the highest point of the top-most portion of handle 710, fold line 614, is lower than top panels 22 of the cartons. This allows the combination of the cartons and tray to be stacked without interference from a handle.

Figure 8:
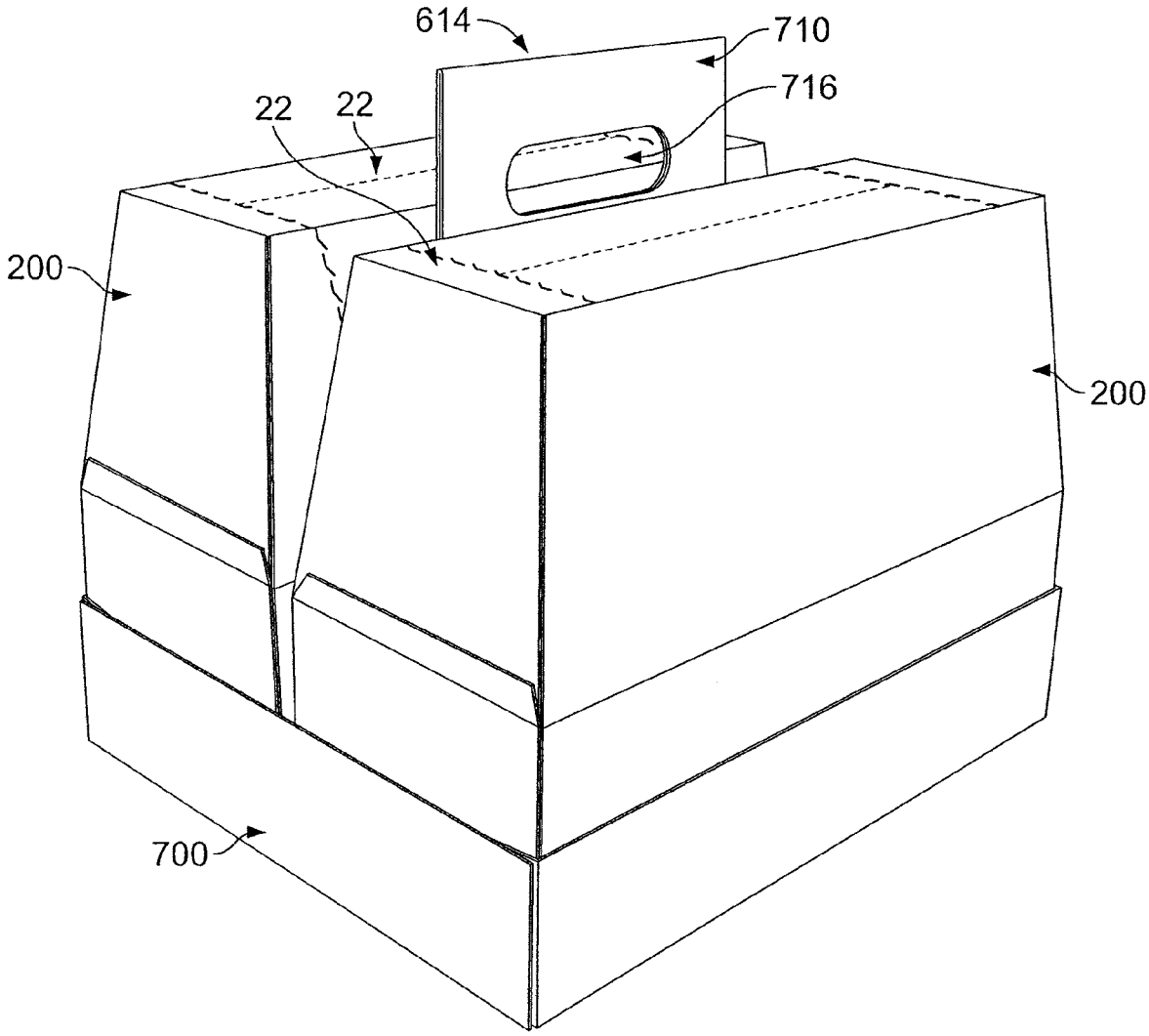
FIG. 8 is a perspective view of two cartons constructed from the blank shown in FIG. 1 placed within a tray constructed from the blank shown in FIG. 3 including a handle constructed from the blank shown in FIG. 4, wherein the handle is shown in an extended state.

FIG. 8 is a perspective view of two cartons 200 constructed from blank 10 shown in FIG. 1, placed within tray 700 constructed from blank 400 shown in FIG. 3, including handle 710 constructed from blank 600 shown in FIG. 4, with the handle shown in an extended state. When handle 710 is in an extended state, shoulders 650 abut fold lines 452 and 454 and handle opening 716 is at least partially above top panels 22 of the cartons. This allows a user to easily place his fingers through opening 716 and carry the tray and cartons.

Figure 9:
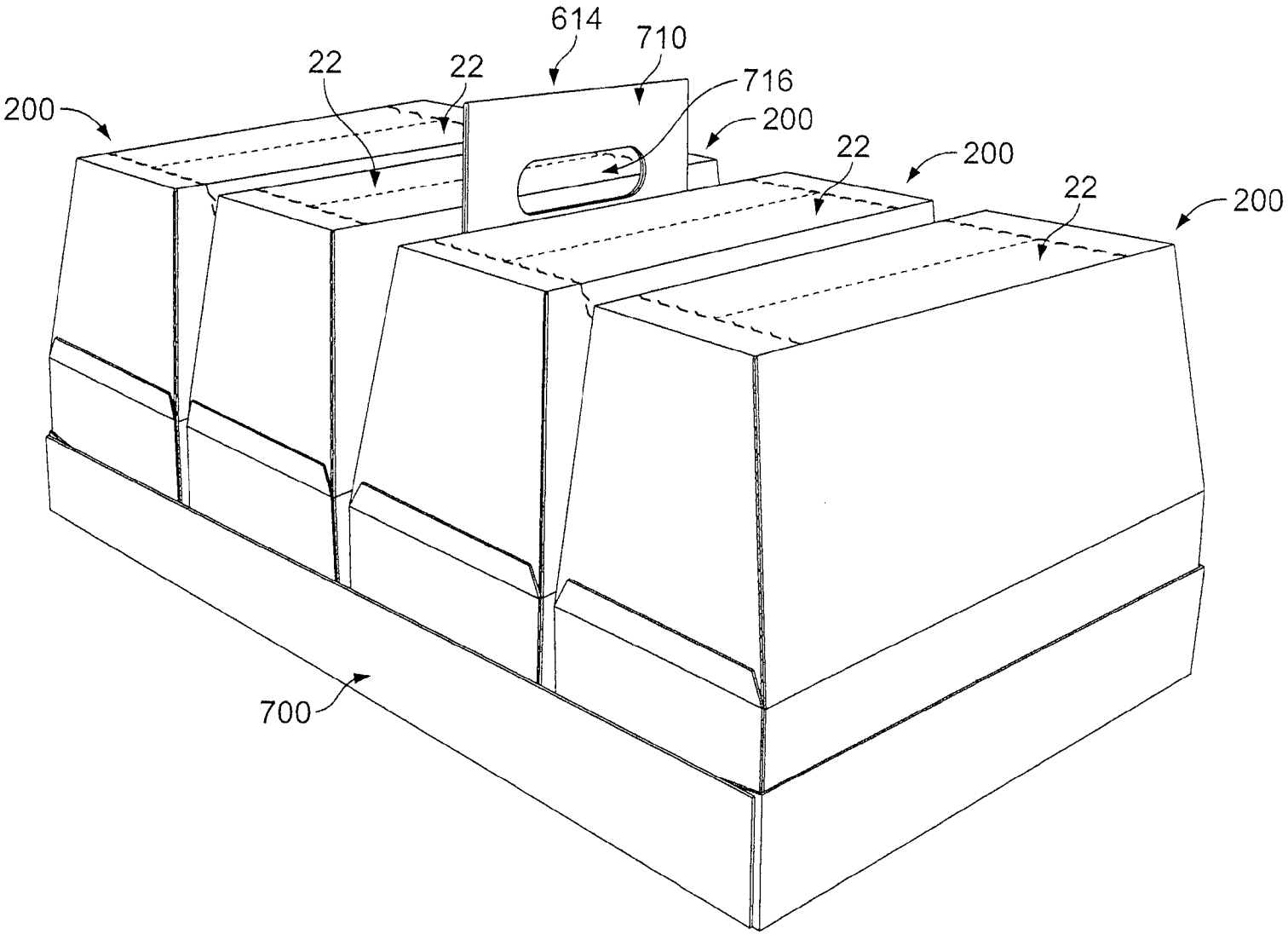
FIG. 9 is a perspective view of four cartons constructed from the blank shown in FIG. 1 placed within a tray constructed from the blank shown in FIG. 3 including a handle constructed from the blank shown in FIG. 4, wherein the handle is shown in an extended state.

FIG. 9 is a perspective view of four cartons 200 constructed from blank 10 shown in FIG. 1, placed within tray 700 constructed from blank 400 shown in FIG. 3, including handle 710 constructed from blank 600 shown in FIG. 4, with the handle shown in an extended state.

While the invention has been described in terms of various specific embodiments, those skilled in the art will recognize that the invention can be practiced with modification within the spirit and scope of the claims.

The invention claimed is:

1. A carrier assembly comprising:

a tray and at least one handle panel;

the tray comprising:

a first tray portion including a first bottom panel disposed between a first edge wall and a first divider panel, wherein the first bottom panel is foldably connected to the first divider panel at a first bottom fold line;

a second tray portion including a second bottom panel disposed between a second edge wall and a second divider panel, wherein the second bottom panel is foldably connected to the second divider panel at a second bottom fold line;

the first divider panel and the second divider panel connected along a divider fold line; an opening along the divider fold line;

the at least one handle panel having an upper portion and a lower portion; the upper portion being sized to be extendable through the opening formed along the divider fold line; the lower portion being sized to engage the divider fold line to prevent the lower portion from extending through the opening.

2. The carrier assembly of claim 1 wherein the first divider panel, the second divider panel, and the at least one handle panel are generally planar with respect to one another.

3. The carrier assembly of claim 1 wherein the at least one handle panel includes two handle panels connected along a handle fold line.

4. The carrier assembly of claim 2 wherein the first divider panel, the second divider panel, and the two handle panels are generally planar with respect to one another.

5. The carrier assembly of claim 1 wherein the first tray portion is defined by the first bottom panel, the first divider panel, and three upstanding edge wall panels.

6. The carrier assembly of claim 1 wherein the second tray portion is defined by the second bottom panel, the second divider panel, and three upstanding edge wall panels.

7. The carrier assembly of claim 1 wherein the at least one handle panel includes a first handle opening in the upper portion.

8. The carrier assembly of claim 1 wherein the at least one handle panel includes two handle panels with a handle opening in the upper portion of each of the two handle panels.

9. The carrier assembly of claim 8 wherein the two handle panels are connected along a handle fold line and wherein the handle opening in the two handle panels are adjacent when the two handle panels are folded about the handle fold line.

10. The carrier assembly of claim 1 wherein the second bottom panel includes a plurality of tabs extending from an interior edge, and wherein the first divider panel and the second divider panel include a plurality of aligned tab openings sized to receive the second bottom panel tabs.

11. The carrier assembly of claim 1 in combination with a plurality of cartons, each carton of the plurality of cartons comprising:

a top wall, a bottom wall, a first end wall, an opposing second end wall, a first side wall, and an opposing second side wall, the first and second end walls and the first and second side walls extending between the top wall and the bottom wall;

wherein the first and second side walls each comprise an upper panel and a lower panel coupled along a side wall fold line, and the first and second end walls comprise an upper and a lower end flap; and, a tear strip located in the top wall and the second side wall upper panel;

wherein a width and height of the top wall is less than a height and width of the bottom wall, wherein the top wall is opposed and parallel the bottom wall, wherein the lower side panels of the first and second side walls are substantially perpendicular to the bottom wall, wherein the lower end flaps of the first and second end walls are substantially perpendicular to the bottom wall, wherein the upper panels of the first and the second side wall are angled inwardly from the lower panels of the first and second side walls, and wherein the upper flaps of the first and second end walls are angled inwardly from the lower flaps of the first and second end walls;

wherein the tray is sized to receive the plurality cartons.

12. A method of constructing a carrier, said method comprising:

providing a tray blank of sheet material, the tray blank comprising a first and a second bottom panel, each bottom panel comprising an inner edge and an outer edge; a first outer edge panel extending from the outer edge of the first bottom panel and a second outer edge panel extending from the outer edge of the second bottom panel; a first divider panel extending from the inner edge of the first bottom panel, wherein the first bottom panel is foldably connected to the first divider panel at a first bottom fold line, and a second divider panel extending from the inner edge of the second bottom panel, wherein the second bottom panel is foldably connected to the second divider panel at a second bottom fold line, wherein first and second divider panels are coupled along a divider fold line; and a handle opening extending along a portion of the divider fold line;

providing a handle blank of sheet material, the handle blank comprising at least one handle panel; the at least one handle panel comprising an upper portion and a bottom portion, a width of the handle upper portion is less than a width of the handle lower portion so that the handle upper portion is extendable through the handle opening in the tray divider wall and the handle lower portion engages the divider fold line to prevent the second handle portion from extending through the handle opening;

forming the tray by folding the first and second outer edge panels about respective fold lines, folding first and second divider panels into a planar relationship, and folding first and second bottom panels about respective fold lines;

inserting the at least one handle panel upper portion through the handle opening; and wherein the divider panels divide the tray into a first carton holding area and a second carton holding area.

* * * * *